US007891747B2

(12) United States Patent
Hahn

(10) Patent No.: US 7,891,747 B2
(45) Date of Patent: Feb. 22, 2011

(54) GLASS CABINET FOR STORAGE AND/OR DISPLAY OF OBJECTS

(75) Inventor: Thomas Hahn, Frankfurt am Main (DE)

(73) Assignee: Glasbau Hahn GmbH + Co. KG, Frankfurt am Main (DE)

( * ) Notice: Subject to any disclaimer, the term of this patent is extended or adjusted under 35 U.S.C. 154(b) by 554 days.

(21) Appl. No.: 11/919,002

(22) PCT Filed: Apr. 22, 2006

(86) PCT No.: PCT/EP2006/003719

§ 371 (c)(1),
(2), (4) Date: Oct. 22, 2007

(87) PCT Pub. No.: WO2007/019891

PCT Pub. Date: Feb. 22, 2007

(65) Prior Publication Data

US 2008/0290765 A1 Nov. 27, 2008

(30) Foreign Application Priority Data

Apr. 29, 2005 (DE) ..... 10 2005 020 440

(51) Int. Cl.
*A47F 3/00* (2006.01)
*E05D 15/58* (2006.01)
*A47B 88/00* (2006.01)

(52) U.S. Cl. ..... 312/139.1; 312/322

(58) Field of Classification Search ..... 312/139.1, 312/138.1, 139.2, 322–323, 309–311, 326–329
See application file for complete search history.

(56) References Cited

U.S. PATENT DOCUMENTS 948,521 A * 2/1910 Payne ..... 312/117
984,006 A * 2/1911 Kade ..... 312/139.2
1,094,695 A * 4/1914 Henson ..... 312/139.1
2,569,254 A 9/1951 Page (Continued)

FOREIGN PATENT DOCUMENTS

DE 534 177 C 9/1931

(Continued)

*Primary Examiner*—Darnell M Jayne
*Assistant Examiner*—Timothy M Ayres
(74) *Attorney, Agent, or Firm*—Bucknam and Archer

(57) ABSTRACT

A glass cabinet for storage and/or display of objects includes a front, a rear (2), a right (3) and a left lateral surface (4), a bottom piece (5) and an upper piece (6) forming the top, at least one lateral surface, for example, the front lateral surface being formed as a glass door (1), in the closed state of the glass cabinet, the interior thereof being sealed in an airtight manner to the environment and the door (1) being mounted displaceably laterally parallel by a guide means mounted in the region of the upper piece or the lower piece or respectively in the region of the upper and the lower piece until release of half of the door opening. In this position, the guide means is formed in such a manner that the projecting part of the door (1) can be pivoted in this position so far that this part of the door (1) adjoins the left (3) or right lateral surface (4). Such a design of a glass cabinet is particularly suitable for those with a very large width.

6 Claims, 2 Drawing Sheets

U.S. PATENT DOCUMENTS

Figure 1A:
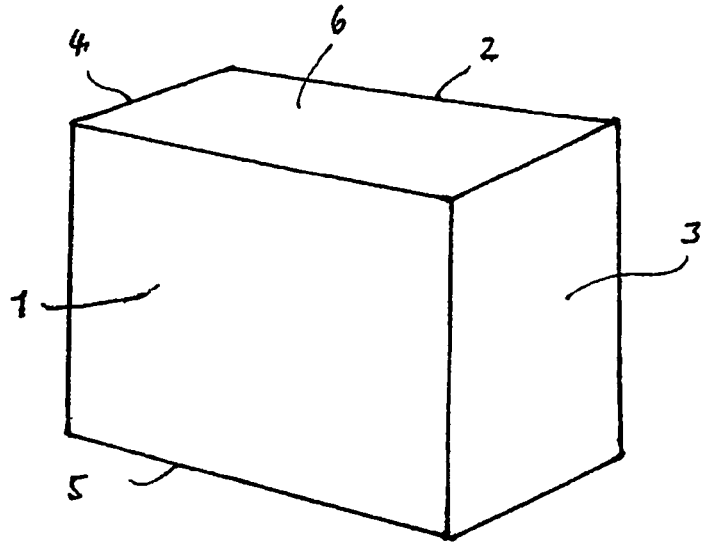

| | | | | |
|---|---|---|---|---|
| 3,771,847 | A | 11/1973 | Aylworth | |
| 5,069,512 | A * | 12/1991 | Sykes | 312/139.2 |
| 2006/0267466 | A1 * | 11/2006 | Marroquin et al. | 312/323 |

FOREIGN PATENT DOCUMENTS

| | | | |
|---|---|---|---|
| DE | 20 20 844 | A1 | 12/1971 |
| DE | 102 61 523 | A1 | 12/2002 |
| EP | 1 449 999 | A | 8/2004 |
| WO | WO 02/101185 | A | 12/2002 |

* cited by examiner

GLASS CABINET FOR STORAGE AND/OR DISPLAY OF OBJECTS

CROSS REFERENCE TO RELATED APPLICATIONS

Applicant claims priority under 35 U.S.C. §119 of German Application No. 10 2005 020 440.6, filed Apr. 29, 2005. Applicant also claims priority under 35 U.S.C. §365 of PCT/EP2006/003719, filed Apr. 22, 2006. The international application under PCT article 21(2) was not published in English.

The invention relates to a glass cabinet for storage and/or display of objects, comprising a front, a rear, a right and a left lateral surface, a bottom piece and an upper piece forming the top, at least one lateral surface, for example, the front lateral surface being formed as a glass door, in the closed state of the glass cabinet, the interior thereof being sealed in an airtight manner to the environment and the door being mounted displaceably laterally parallel by a guide means mounted in the region of the upper piece or the lower piece or respectively in the region of the upper and the lower piece.

Such a glass cabinet is already known and is, for example, described in DE 102 61 523 A1. Glass cabinets are used to display cultural and artistic objects in exhibitions and museums, in which case, as well as protection of objects from the surrounding area, it should be possible to look at the objects without hindrance where possible. It can occur that an object with very large dimensions should be introduced into the glass cabinet. In this case, it is expedient to design the glass cabinet in such a manner that the entire door opening is released in its full width between the right and the left lateral wall. The simplest solution would be a simple pivotable door. However, such a solution faces problems when the glass cabinet is intended to have very large dimensions for specific reasons. A laterally displaceable door has the shortcoming that in the event of a simple pulling out the door can only be displaced so far that the door opening is released by half at the most.

The object of the invention lies in forming a glass cabinet of the type described above such that, when in the opened state of the door, the opening thereof is released in its full size.

This object is achieved in that the door is laterally displaceable until the release of the half of the door opening and can be pivoted in this position by a corresponding design of the guide means so far that the projecting part of the door adjoins the left or the right lateral surface in a parallel manner, the guide means being designed in such a manner that the center of gravity of the door is always located close to the glass cabinet.

Even in the case of a glass cabinet with a large width, i.e. with a very long front, the pivoting range of the door is only half its width, which enables a space-saving arrangement of the glass cabinets in an exhibition space. A further advantage of the glass cabinet according to the invention lies in the fact that no stability problems occur in the case of glass cabinets with a particularly small depth since, as a result of the pivotable bearing of the door in the opened state, its weight is balanced in relation to the point of rotation insofar as no tension occurs at the front of the glass cabinet.

Further advantageous embodiments of the invention will become apparent from the subordinate claims.

Figure 1B:
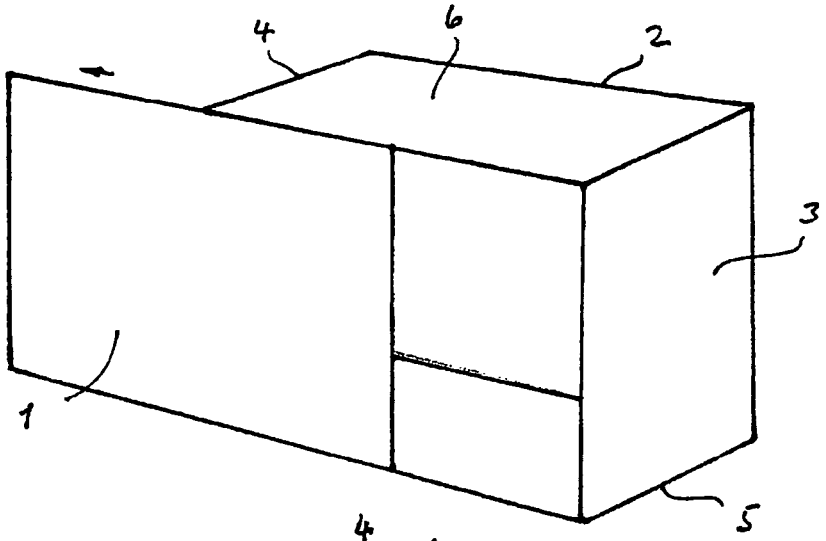
Figure 1C:
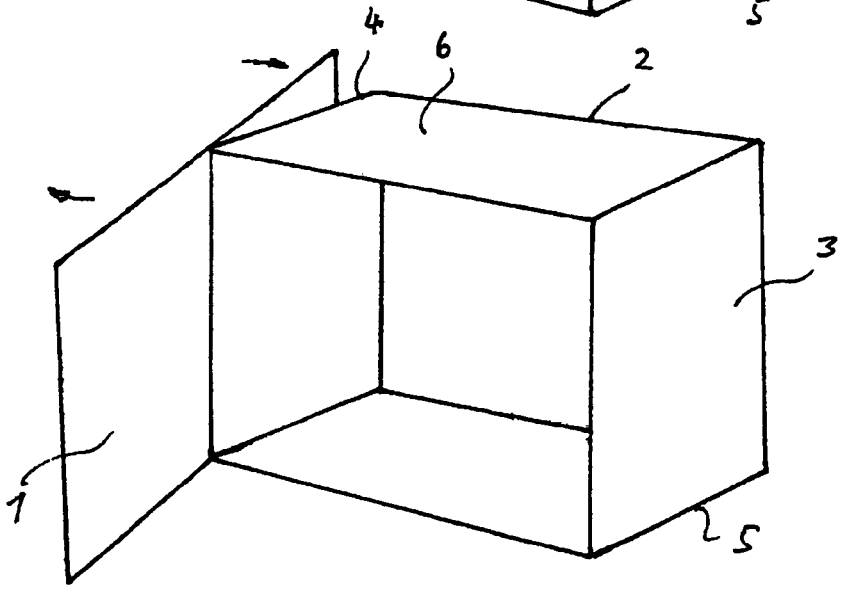
Figure 2:
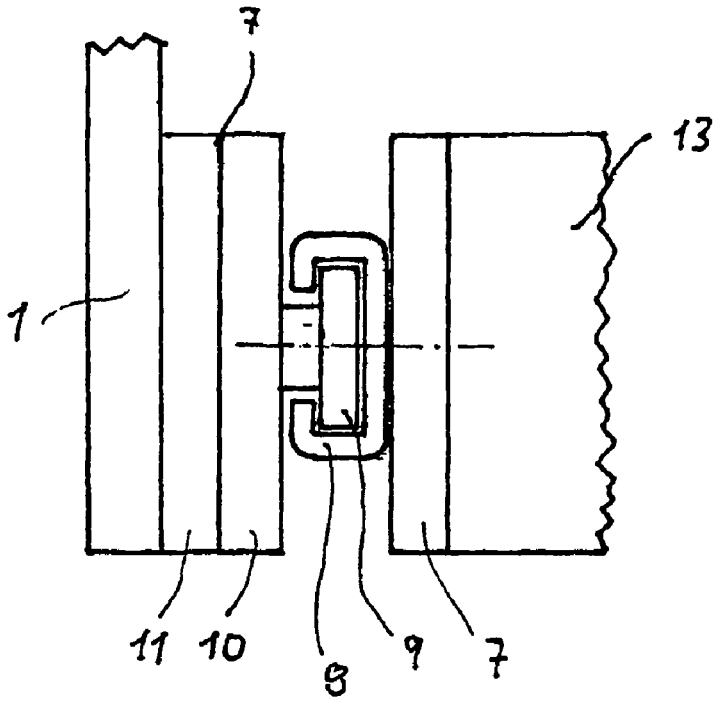
Figure 3:
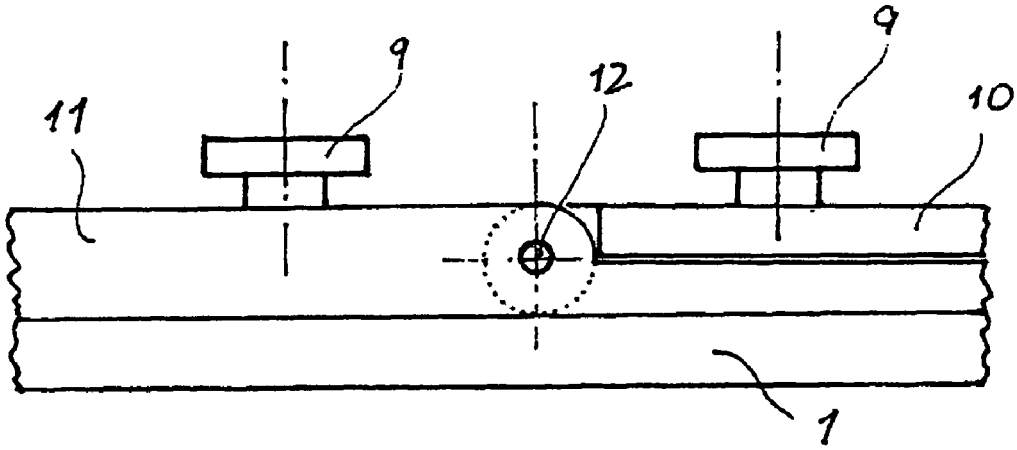

The invention is explained in greater detail with reference to an exemplary embodiment which is shown in the drawing. Therein:

FIG. 1*a* shows the perspective view of a glass cabinet in the closed state, FIG. 1*b* shows this glass cabinet with a laterally displaced door, FIG. 1*c* shows this glass cabinet with an opened and laterally pivoted door, FIG. 2 shows a side view of the guide means and FIG. 3 shows a top view of the guide means.

The glass cabinet shown in FIG. 1 comprises a front, a rear 2, a right 3 and a left lateral surface 4, a bottom piece 5 and an upper piece 6 forming the top, the front lateral surface being formed as door 1. All the lateral surfaces or only a part thereof can be composed of transparent or non-transparent discs. Bottom piece 5 forms the base of the glass cabinet.

Door 1 is formed as a sliding door, the door opening being released by half and thus the access to the interior of the glass cabinet being released by lateral displacement of said sliding door. For this purpose, a guide means 7, which can e.g. be formed as a sliding, ball or roller bearing, is respectively mounted in the region of upper piece 6 or of lower piece 5 or in the region of upper piece 6 and of lower piece 5 of the glass cabinet. Guide means 7 comprises a first 8 and a second arrangement 9, for example, a guide for receiving rollers (FIG. 2). In the exemplary embodiment, it is assumed that the guide is assigned to the housing of glass cabinet 13 and the rollers to door 1, however, it is also perfectly conceivable to correspondingly switch this assignment.

Second arrangement 9 is composed of a fixed 10 and a movable piece 11, both pieces 10, 11 comprising a plurality of the rollers arranged in a flush manner and already mentioned above. In this case, the length of movable piece 11 corresponds to the width of door 1. Both pieces 10, 11 are provided in the region of the center of door 1 with a bearing 12 (FIG. 3), by means of which movable piece 11 is rotatably connected with fixed piece 10, the rotational axis of bearing 12 running perpendicular and parallel to door 1 which is fixedly connected to movable piece 11.

If door 1 is now displaced laterally in guide means 7, the rollers then move in the guide to one side, the rollers which are assigned to movable piece 11 one-by-one leaving the guide until only the rollers of fixed piece 10 are located in the guide. In this position, a stop can ensure that the process of displacement of door 1 cannot continue further.

For lateral pivoting of door 1, fixed 10 and movable piece 11 are fixedly and detachably connected to one another in such a manner that by suitable means, not shown, the fixed connection between fixed 10 and movable piece 11 can only be detached when door 1 is located in the end position of the pushed out state. It is only then possible to swivel door 1 to right 3 or left lateral surface 4 of the glass cabinet. In the case of the exemplary embodiment shown in FIG. 3, a simple bearing 12 is assumed for a rotational movement. However, it is also conceivable for specific reasons to instead deploy a multiply-articulated hinge in order, for example, to obtain a larger freedom of design, when specifying the point of rotation between fixed 10 and movable part 11. If door 1 is now displaced laterally, the center of gravity thereof and the point of rotation of the swiveling movement move in the same manner, the position of both points being identical and these being located outside but as close as possible to the glass cabinet.

In the edge region of door 1, sealing lips can be mounted on glass cabinet 13 or on the door itself, said sealing lips, in the closed state of the door, sealing the interior of glass cabinet 13 in an airtight manner to the environment. For this purpose and possibly also for esthetical reasons, the glass cabinet can be designed in such a manner that the front edge at least of right 3 and left lateral surface 4 in the closed state of door 1 seal with the outer face thereof in a flush manner. Before the process of opening door 1 in the context of displacement of the door can begin, door 1 must first move out of glass cabinet 13. This happens as a result of the fact that first arrangement 8 of guide means 7 is connected to glass cabinet 13 in parallel displaceably to right 3 and left lateral surface 4. This can, for example, be achieved by respectively two cylindrical guides, not shown, which are fixedly mounted between glass cabinet 13 and first arrangement 8. After releasing a catch, not shown, door 1 is, for example, possibly moved forwards by spring force or by its own dead weight on the cylindrical guides so that guide means 7 protrudes out of glass cabinet 13 so far that door 1 can be pushed laterally past the front edge of left 3 or right lateral surface 4.

In order to close the glass cabinet, door 1 is first moved back into the position in which fixed 10 and movable piece 11 of second arrangement 9 lie on top of one another again, both parts are subsequently locked together, whereupon door 1 can only then be displaced again into the closing position from which it can then be pressed into the glass cabinet and subsequently locked again in this position.

The invention is not restricted to exhibition glass cabinets and can also be applied to devices for storing objects with large dimensions.

REFERENCE NUMBERS

1. Front lateral surface
2. Rear lateral surface
3. Right lateral surface
4. Left lateral surface
5. Lower piece
6. Upper piece
7. Guide means
8. First arrangement
9. Second arrangement
10. Fixed piece
11. Movable piece
12. Bearing
13. Glass cabinet

The invention claimed is:

1. A glass cabinet (13) for storage and/or display of objects, having a front, a rear, a right and a left lateral surface, a bottom piece and an upper piece forming the top, the front lateral surface being formed as a glass door (1), in the closed state of the glass cabinet the interior thereof is sealed in an airtight manner to the environment, said glass door (1) being mounted displaceably laterally parallel by a guide means (7) mounted in a location selected from the region of said upper piece, the region of said lower piece or both the regions of said upper and lower pieces, said guide means (7) comprising a first arrangement (8) associated with said glass cabinet (13) and a second arrangement (9) associated with said glass door (1), said second arrangement (9) includes a fixed piece (10) and a movable piece (11) rotatably connected to said fixed piece (10) by a bearing (12) mounted in the region of the center of said glass door (1) with the rotational axis of said bearing (12) being parallel to said glass door (1), said movable piece (11) being fixedly connected to said fixed piece (10) during the lateral displacement of said glass door (1) up to release of half of the door opening at which point the fixed connection is released so that said movable piece (11) is free to rotate relative to said fixed piece (10) about said bearing (12), whereby said glass door (1) is pivotable about said bearing (12) so that the projecting part of the door (1) adjoins the left lateral surface (4) or the right lateral surface (3) in parallel.

2. The glass cabinet as claimed in claim 1, wherein by suitable means, the point of rotation of the door (1) is moved outwards in the end position of the opened state.

3. The glass cabinet as claimed in claim 1, wherein in the fully opened state of the door (1), the center of gravity thereof is located in the point of rotation of the bearing (12).

4. The glass cabinet as claimed in claim 1, wherein the first arrangement (8) of the guide means (7) is fixedly connected to the glass cabinet.

5. The glass cabinet according to claim 4, wherein the door (1), in the closed state, is encompassed on both sides by the left (4) and the right lateral surface (3) in the edge region and that the first arrangement (8) of the guide means (7) is connected by corresponding guides to the glass cabinet (13), the first arrangement (8) being capable of being moved out of the glass cabinet (13) after release of a catch.

6. The glass cabinet according to claim 1, wherein the first arrangement (8) of the guide means (7) is mounted in parallel displaceably to the right (3) and/or the left lateral surface (4) of the glass cabinet (13).

* * * * *